US010995512B1

(12) United States Patent
Neighbor

(10) Patent No.: US 10,995,512 B1
(45) Date of Patent: May 4, 2021

(54) TEMPORARY SUPPORT STRUCTURE

(71) Applicant: OSMOSE UTILITIES SERVICES, INC., Peachtree City, GA (US)

(72) Inventor: Kristopher Mark Neighbor, Peachtree City, GA (US)

(73) Assignee: Osmose Utilities Services, Inc., Peachtree City, GA (US)

( * ) Notice: Subject to any disclaimer, the term of this patent is extended or adjusted under 35 U.S.C. 154(b) by 0 days.

(21) Appl. No.: 16/783,124

(22) Filed: Feb. 5, 2020

(51) Int. Cl.
*E04H 12/34* (2006.01)
*E04H 12/22* (2006.01)
*E04H 12/10* (2006.01)

(52) U.S. Cl.
CPC ..... *E04H 12/2292* (2013.01); *E04H 12/344* (2013.01); *E04H 12/10* (2013.01)

(58) Field of Classification Search
CPC ... E04H 12/2292; E04H 12/344; E04H 12/10; E04H 12/345; B66F 3/46
USPC ..... 52/123.1, 126.1, 745.17
See application file for complete search history.

(56) References Cited

U.S. PATENT DOCUMENTS 2,656,149 A * 10/1953 Campbell ..... E04H 12/34 254/92
4,678,372 A * 7/1987 Cousty ..... E02B 17/00 405/196
5,322,265 A * 6/1994 Keuck ..... E04H 12/34 254/89 H
9,097,033 B2 * 8/2015 Margevicius ..... E04H 12/344
9,562,367 B2 * 2/2017 Chaput ..... E04H 12/344
2014/0083025 A1 * 3/2014 Richardson ..... E02D 5/803 52/126.1
2019/0161332 A1 * 5/2019 Chaput ..... B66F 11/04

* cited by examiner

*Primary Examiner* — Patrick J Maestri
(74) *Attorney, Agent, or Firm* — Troutman Pepper Hamilton Sanders LLP

(57) ABSTRACT

The disclosed technology includes temporary support structures for use in the repair of a transmission tower. A typical transmission tower includes a tripod that receives the load of the tower and distributes it to piles embedded in the ground. A temporary support structure can temporarily remove the load of the transmission tower from the tripod to enable removal of the tripod and installation of a new tripod. A temporary support system can include a bearing platform system attachable to piles of the transmission tower, a bearing frame supported by the bearing platform system, a lifting system supported by the bearing frame, and a flower pot adapter configured to attach to a portion of the transmission tower, and the temporary support system can thereby be configured to remove the load of the transmission tower from the tripod of the transmission tower.

20 Claims, 7 Drawing Sheets

TEMPORARY SUPPORT STRUCTURE

BACKGROUND

Many electrical utility companies utilize guyed lattice tower assets (e.g., a guyed latticed mast transmission tower) supported by a tripod grillage that bears on steel piles (e.g., helical piles). These towers are often located in remote areas, such as wetlands or tidal areas, that can have environments that lead to accelerated corrosion of the tripod, as well as brackets and adapters positioned at the interfaces between the bottom of the tripod and the top of the support piles. When the tower foundation has significant deterioration, traditionally a utility's typical option was to completely replace the tower with a new structure, which is costly and may cause significant environmental disruption to the environmentally sensitive areas in which many such towers are located. The many challenges associated with replacement of such towers, such as environmental access, environmental preservation, critical service requirements, and budgetary issues can make tower replacement a very impractical solution. Therefore, a low impact, moderate cost solution that enables the restoration or replacement of a tower tripod, bracket, and/or adapter without the need to replace the tower would provide economic and environmental benefits. In some cases, a tripod of a guyed latticed mast tower may be so severely deteriorated that it may not be practical to reinforce the structure of the tripod, but instead it may be necessary to replace some or all of the tripod.

Certain systems and methods exist to provide a ground-supported structure to assist in repairing certain components of a tower, such systems require the installation of new and/or temporary piles (e.g., screwed or driven into the ground). This can be difficult and time consuming, depending on the terrain and ground conditions. Accordingly, there is a need for an apparatus that can enable the replacement of the tripod, as well as the associated brackets and adapters, without moving the tower, removing the tower from service, or building an additional pile structure.

SUMMARY

These and other problems are addressed by certain aspects and attributes of the disclosed technology. For example, the disclosed technology relates to temporary support structures (e.g., "inverted" temporary support structures) as described and can enable the repair and/or replacement of the tripod of a tower and/or latticed structure, as well as associated brackets and/or adapters or other parts, without relocating the transmission tower or removing the tower from service. As an example, the temporary support structure can be capable of transferring the load of a tower from the base of the mast, through the temporary support structure, and back into the existing piles, thereby bypassing the tower's tripod, as well as temporarily lifting the tower above and away from the tripod.

In general, a temporary support structure can enable a guyed lattice mast tower to be temporarily supported (and raised, if required) independent of the existing tripod atop the foundation piles so that the tripod, brackets, pile adapters, and/or other components of the tower can be replaced and/or the upper portions of the piles can be restored. The temporary support structure can include a bearing platform system comprising a plurality of pile bearing platforms that are each configured to attach to a respective pile of the existing tower foundation. The bearing platform system can include bracing (e.g., transverse struts) extending between pile bearing platforms, such as between each pair of adjacent pile bearing platforms).

The temporary support system can include a bearing frame configured to be installed on top of, and supported by, the bearing platform system. The bearing frame can comprise a plurality of bearing beams. Each bearing beam can extend between a pair of adjacent pile bearing platforms. As such, the bearing beams can form a substantially enclosed shape around the tower. For example, the bearing beams can form a triangle with three sides. The vertices of the triangle can approximately align with the bearing platforms, and/or each side of the triangle can be positioned to be approximately perpendicular to a corresponding arm of the existing tripod. The bearing beams can form other shapes (e.g., polygonal shapes). Optionally, the shape can correspond to the tower's existing pile configuration (e.g., each side of the shape can correspond to a respective pile and/or a face of the tower's flower pot). Thus, the bearing beams can form a square or rectangle, a pentagon, a hexagon, or some other shape.

The temporary support system can include a lifting system configured to be installed on top of, and supported by, the bearing frame. The lifting system can include one or more jacks or other devices configured to raise and lower an object. As an example, the lifting system can include a jack corresponding to each bearing beam. The jack(s) can be one or more screw jacks, one or more hydraulic jacks or hydraulic rams, or any other lifting device. The temporary support structure can include a flower pot adapter assembly that can be attached to the mast base, also referred to as a "flower pot," of the tower above the existing tripod to transfer the load of the tower to the temporary support structure. For example, the flower pot adapter assembly can be configured to attach to a flower pot of the tower. The flower pot adapter assembly can have a bottom surface configured to contact at least a portion of the lifting system (e.g., a portion of the jacks that can extend as the jacks transition from a lowered configuration to a raised configuration) to transfer a load of the transmission tower to the plurality of piles via the temporary support structure. Once the load of the tower is transferred to the temporary support structure, the existing tripod, brackets, and pile adapters can be accessed for repair, restoration, or replacement.

This disclosed technology includes methods for removing the load from a tripod of a transmission tower. For example, the disclosed technology includes a method that can include attaching a pile bearing platform assembly to existing piles of the transmission tower. The method can include assembling a bearing frame on top of the pile bearing platform assembly such that the pile bearing platform assembly supports the bearing frame. The bearing frame can include a plurality of bearing beams. The method can include assembling a lifting system on top of the bearing frame such that the bearing frame supports the lifting system (i.e., the load of the lifting system is transferred to the piles via the bearing platform and the pile bearing platform assembly). The method can include attaching a flower pot adapter assembly to a flower pot of the transmission tower. As will be appreciated, the flower pot (e.g., mast base) can be positioned above the tripod (i.e., the existing tripod) and can be configured to hold the guyed latticed mast of the transmission tower. The method can include causing the lifting system to raise the flower pot adapter assembly such that the load of the transmission tower can be transferred from the transmission tower to the flower pot adapter assembly, from the flower pot adapter assembly to the lifting system, from the lifting system to the bearing frame, from the bearing frame to the pile bearing platform assembly, and from the pile bearing platform assembly to the existing piles of the tower's base.

Other examples, embodiments, features, and aspects of the disclosed technology are described in detail herein and are considered a part of the claimed disclosed technology. Other embodiments, features, and aspects can be understood with reference to the following detailed description, accompanying drawings, and claims.

BRIEF DESCRIPTION OF THE FIGURES

Reference will now be made to the accompanying figures and flow diagrams, which are not necessarily drawn to scale, and wherein.

DETAILED DESCRIPTION

Figure 1:
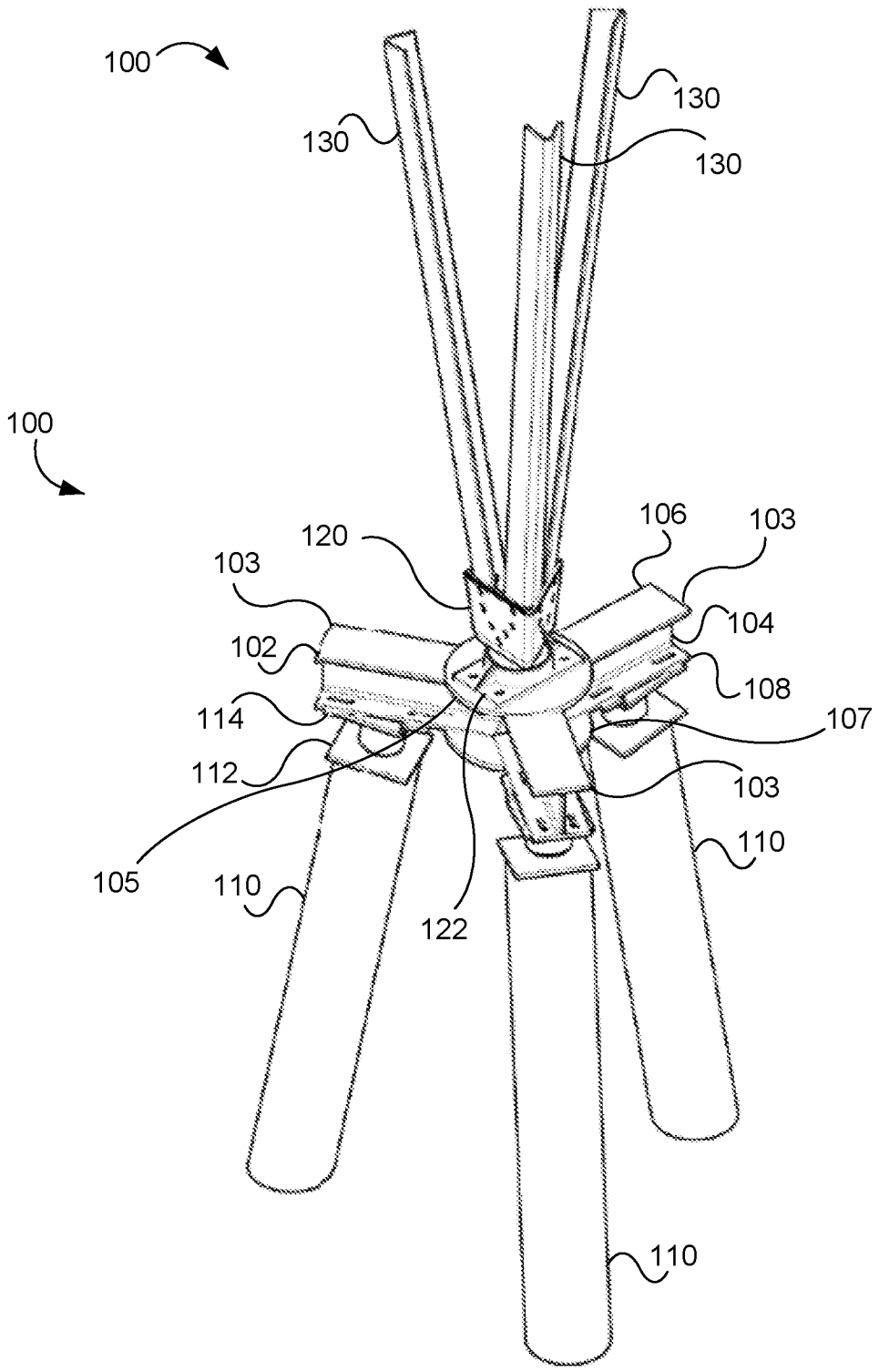
FIG. 1 illustrates a perspective view of an example transmission tower tripod and corresponding piles.

The disclosed technology includes a temporary support structure and related methods that can be used to repair a transmission tower and, in particular, can be used to replace a degraded tripod installed at the transmission tower without requiring removal of the tower from service or replacement of the tower itself. The technology described in the instant disclosure is related to, but patentably distinct from, U.S. patent application Ser. No. 15/994,399, now U.S. Pat. No. 10,385,534, the disclosure of which is incorporated herein by reference in its entirety.

The disclosed technology includes a temporary support structure to enable repair or replacement of a tripod or other component that is damaged, as described herein. The temporary support structure can be "inverted" insofar as a lifting system can be situated on bearing beams such that the lifting system can provide force upwardly against a flower pot adapter assembly to lift a tower's flower pot off the underlying tripod. Thus, the disclosed technology can sometimes be referred to as an inverted temporary support structure. Further, although this disclosure is generally directed towards describing the repair or strengthening of transmission towers having a three-sided flower pot, it should be understood that the temporary support structure described herein can be used to repair a wide variety of other types of structures, towers, poles, or the like, including transmission towers having a four-sided flower pot (or any other number of sides) by modifying the flower pot adapter assembly described herein to allow it to securely attach to the outer surface of a portion of said other type of structure, thereby allowing the load of the structure to be supported by the temporary support structure and providing the opportunity to replace parts of the structure from which the load has been temporarily removed. As an illustrative example, the disclosure describes certain assemblies as having three adjacent components of a certain type. In some instances, each of the three components can correspond to one of three piles of the transmission tower and/or to one of the three sides of the flower pot. However, it is to be understood that the technology disclosed herein contemplates modifying such an assembly to include four components to correspond to a tower having four piles and/or a flower pot with four sides or any number of piles and/or any number of flower pot sides, as the case may be.

In accordance with the present disclosure, a temporary support structure can be used temporarily to remove the load of a transmission tower from an installed tripod without requiring the construction and/or installation of additional piles and associated support structure (e.g., a structure that is embedded into, or resting on, the ground), which can allow repair, removal, and/or replacement of the installed tripod. The temporary support structure described herein can be used in conjunction with transmission towers having any pile configuration (e.g., can be used with piles of any diameter). In addition to allowing removal and replacement of the installed tripod, other repairs can be made to the tower during installation, such as for example, trimming of corroded portions of piles and replacement of deteriorated pile adapters and/or pile brackets. The temporary support structure can securely support the load of the transmission tower about the flower pot of the tower. As will be appreciated by those of skill in the art, a mast base (often referred to as a flower pot) can be a mast base forging, weldment, casting, container or other component that is configured to securely hold the legs of the transmission tower (e.g., chordal members at the bottom of the latticed mast). As described more fully below, once a tripod has been removed and a new tripod has been attached to the piles and/or pile adapter/brackets, the flower pot that is being held up by the temporary support structure can be lowered into and received by a flower pot receiver/retainer such as a socket/cup forging, pin, adapter, or similar mechanism positioned on top of the new tripod, such that the load of the tower can be transferred from the temporary support structure to the newly installed tripod. The flower pot can be lowered by lowering a jack assembly (e.g., turning threaded screws of one or more screw jacks) in communication with the flower pot to lower the flower pot. Once the flower pot has been installed onto the flower pot receiver/retainer of the new tripod, the temporary support structure can be deconstructed and removed.

Aspects of the disclosed technology will be described more fully hereinafter with reference to the accompanying drawings. This disclosed technology can, however, be embodied in many different forms and should not be construed as limited to the examples set forth therein.

In the following description, numerous specific details are set forth. However, it is to be understood that various examples of the disclosed technology can be practiced without these specific details. In other instances, well-known methods, structures, and techniques have not been shown in detail in order to not obscure an understanding of this description. References to "one embodiment," "an embodiment," "example embodiment," "some embodiments," "certain embodiments," "various embodiments," "one example," "an example," "some examples," "certain examples," "various examples," etc., indicate that the example(s) of the disclosed technology so described can include a particular feature, structure, or characteristic, but not every implementation of the disclosed technology necessarily includes the particular feature, structure, or characteristic.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Various systems and methods are disclosed for removing the load of a transmission tower from an installed tripod to allow for repair or replacement of the tripod, and will now be described with reference to the accompanying figures.

As described herein, the disclosed technology includes temporary support structures for supporting the load of a transmission tower to allow for removal and replacement of a damaged or degraded tripod or other components. As will be appreciated by those of skill in the art, the base of a transmission tower (e.g., a guyed latticed mast transmission tower) is commonly supported by a tripod having a plurality of beams or arms (e.g., three beams) that are supported by piles that have been installed in the ground. For example, FIG. 1 shows a transmission tower base 100 that includes a tripod 102 having three tripod beams 103 that are supported by the piles 110. The tripod beams 103 can each extend outwardly from a center point and can be equidistantly spaced such that each tripod beam 103 is positioned at a 120-degree angle relative to each adjacent tripod beam 103 (although the angle can differ depending on the number of beams 103, which can differ depending on a corresponding number of piles of the transmission tower base 100, such as a base having four piles). Each tripod beam 103 can include a top plate or flange 106 that is connected to a bottom plate or flange 108 by a tripod web 104 (e.g., an I-beam or a structure similar to an I-beam). The top flange 106 and bottom flange 108 of a tripod beam 103 can be approximately the same shape and/or size and can be positioned parallel to one another such that they are both joined by the tripod web 104 at an approximately perpendicular angle. The top flange 106 and bottom flange 108 of a tripod beam 103 can be approximately rectangular-shaped plates and the tripod web 104 can be positioned approximately along a longitudinal center line of the top flange 106 and/or bottom flange 108. The tripod web 104 can be a substantially planar plate. A given tripod beam 103 can be constructed by combining multiple components (e.g., a combination of the tripod web 104, the top flange 106, and the bottom flange 108), or a given tripod beam 103 can be a single component (e.g., an I-beam or W-beam) having portions corresponding to the tripod web 104, the top flange 106, and the bottom flange 108 described herein. Alternatively or in addition, one or more of the tripod beams 103 can be a hollow structural section or a tube. The tripod beams 103 can be joined or welded together by one or more of an upper member 105 and a lower member 107, forming the tripod weldment, referred to herein as the "tripod 102." For example, as shown in FIG. 1, either of the upper member 105 and lower member 107 can be a plate, such as a circular plate or other suitably shaped plate, that can be attached to a portion of each of the tripod beams 103. The upper member 105 and/or lower member 107 can include one or more apertures configured to align with apertures in the top flange 106 and/or bottom flange 108 of a tripod beam 103 so that they can be attached to one another via bolts, screws, fasteners, or the like. The upper member 105 and/or the top flange 106 can have one or more apertures configured to align with apertures of the flower pot socket 122 to allow the flower pot socket 122 to be attached to the upper member 105. The tripod 102 can be made of metal, such as steel, or another suitable material.

Typically, a transmission tower base 100 can include one-piece pile adapters 112 and brackets 114 that are positioned between the tops of the large piles 110 and the bottoms of each tripod beam 103. The pile adapters 112 and brackets 114 can serve to create a transition connection between the respective piles 110 and the tripod 102. During the original installation, the piles 110 can be positioned or field trimmed such that the brackets 114 are positioned at an approximately equal height so that the tripod 102 can provide a flat base to serve as support for the transmission tower. A bracket 114 that is mated with a pile adapter 112 can be secured to the bottom of a tripod beam 103 by bolts, screws, fasteners, or other connector devices or mechanisms. Transmission tower legs 130 (e.g., chordal members at the bottom of the latticed mast of the tower) can be received by a receiving member or component designed to securely receive and restrain the transmission tower legs 130, such as a flower pot 120. The flower pot 120 can have an approximately ball shaped lower bearing surface and can be positioned in and/or retained by a flower pot socket 122 that is secured (e.g., bolted, screwed, fastened, etc.) on top of the tripod 102 and is configured to securely receive the base of the flower pot 120. Once positioned, the flower pot socket 122 can be secured (e.g., bolted, screwed, fastened, etc.) to the top of the tripod 102.

Figure 2A:
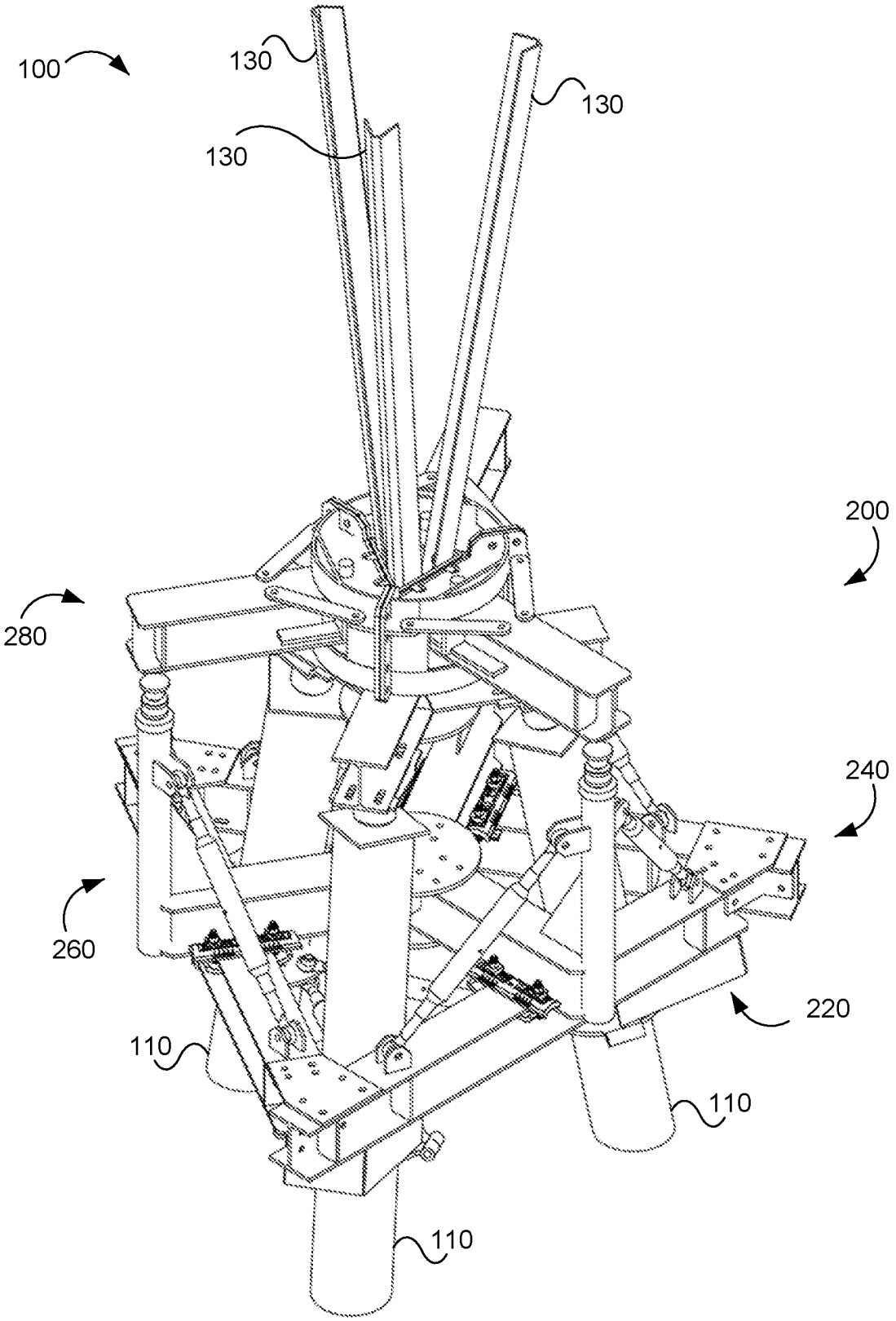
FIG. 2A illustrates a top perspective view of an example assembled temporary support structure for a transmission tower, in accordance with the disclosed technology.
Figure 2B:
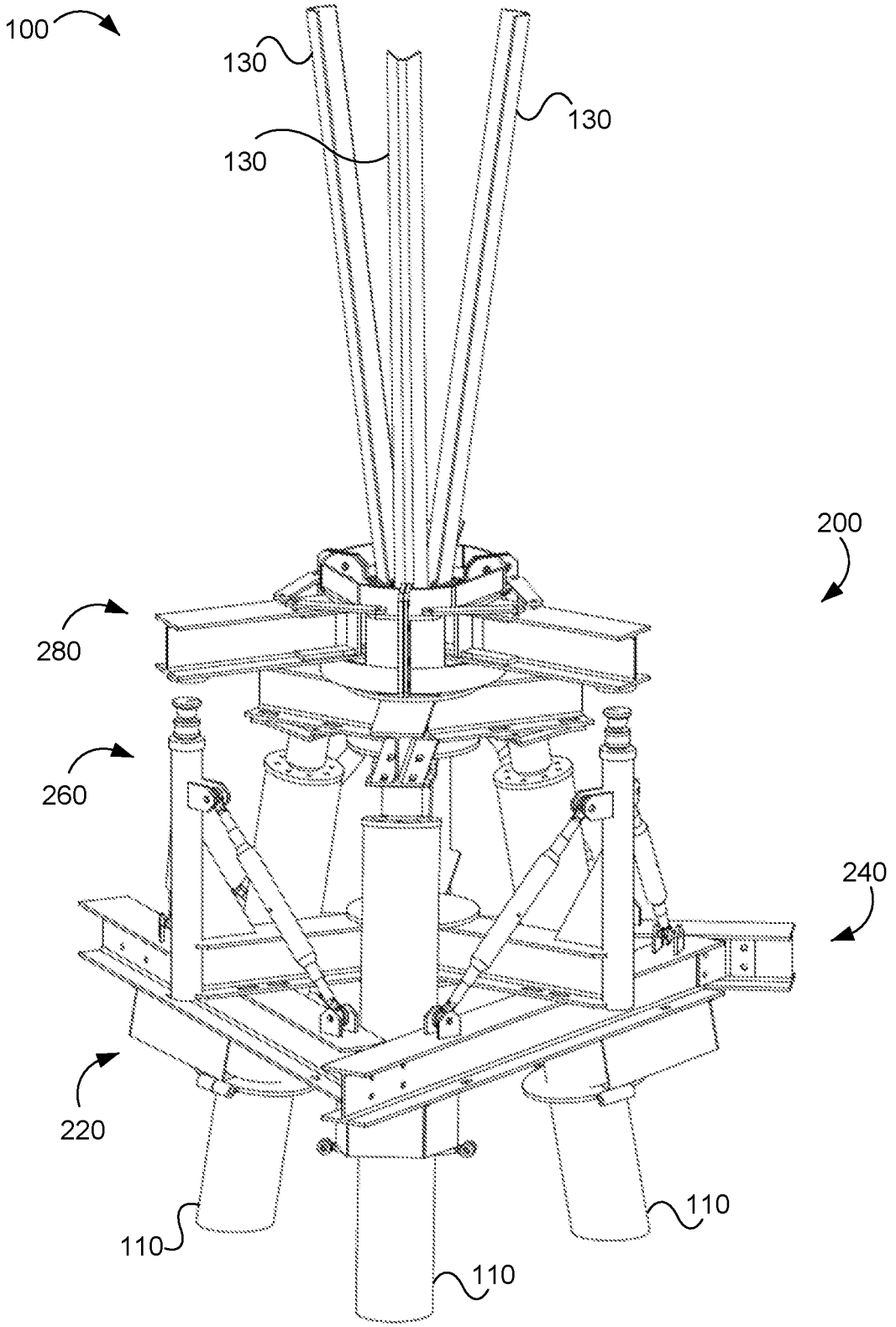
FIG. 2B illustrates a front perspective view of an example assembled temporary support structure for a transmission tower, in accordance with the disclosed technology.

FIGS. 2A and 2B show an example temporary support structure 200 assembled around the base of a transmission tower 100 supported by piles 110. The temporary support structure 200 can include a bearing platform system 220, a bearing frame 240, a lifting system 260, and/or a flower pot adapter assembly 280. As shown in FIGS. 2A and 2B, when assembled, the bearing platform system 220 can attach to the piles 110 and support the bearing frame 240, which can in turn support lifting system 260, which can be configured to lift the flower pot adapter assembly 280 that can be attached to the flower pot 120. Thus, when the temporary support structure 200 is attached to piles 110 and the flower pot 120, the flower pot adapter assembly 280 can transfer the load of the tower from the flower pot 120 to the bearing frame 240 via the lifting system 260, the bearing frame 240 can transfer the load to the bearing platform system 220, and the bearing platform system 220 can transfer the load to the piles 110. In this way, the temporary support structure 200 can transfer the load of the tower from the flower pot 120 to the piles 110, bypassing the tripod 102, thereby removing the load from the tripod 102 to enable repair, restoration, or replacement of the tripod 102. As will be described further below, the lifting system 260 and/or flower pot adapter assembly 280 can be configured to vertically raise and/or lower the flower pot 120 to provide access to the existing tripod 102 and to allow installation of a new tripod 102.

Figure 3:
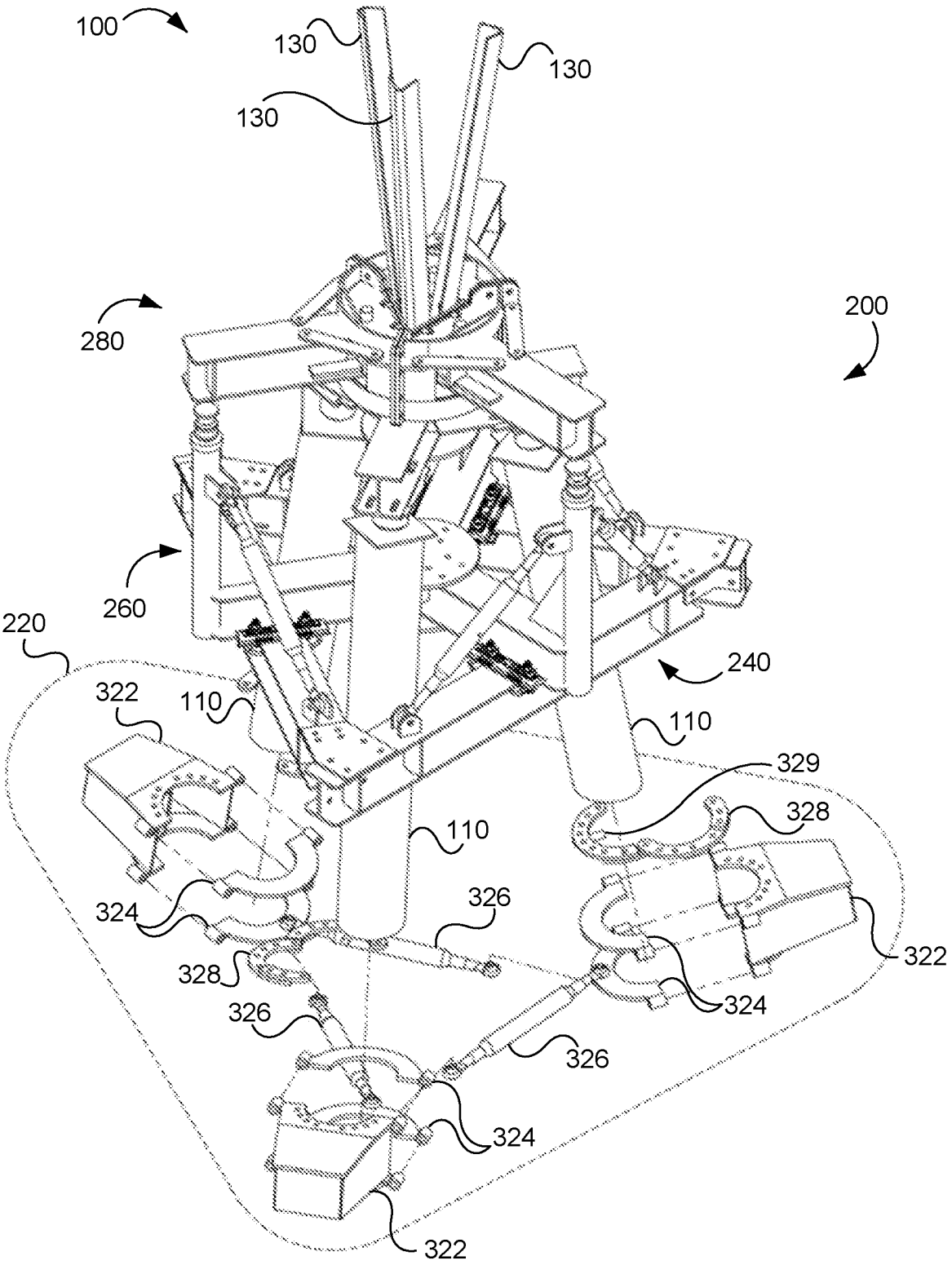
FIG. 3 illustrates a partially exploded perspective view of an example assembled temporary support structure with the pile bearing platform assembly exploded for illustrative purposes, in accordance with the disclosed technology.

FIG. 3 shows a partially exploded view of an assembled temporary support structure 200 for a transmission tower 100. As shown in FIG. 3, a bearing platform system 220 can include one or more of: pile bearing platforms 322, attachment half-rings 324, transverse struts 326, and shear engagement rings 328. The pile bearing platforms 322 can each have a box-like structure with a top, a bottom, and sides, which can define an interior portion, although the box-like structure is not necessarily an enclosed structure. The pile bearing platforms 322 can have a flat top surface and can have an arc-shaped notch or cutout, such as a half-circle notch, configured to mirror the exterior side surface of the pile. The pile bearing platforms 322 can be configured to attach to the piles 110 such that flat top surfaces of each of the pile bearing platforms 322 are approximately level with one another when the pile bearing platforms 322 are installed. The top bearing surface of the pile bearing platform (i.e., the portion of the pile bearing platform configured to support the bearing beams 442, as described below) can be angled with respect to a horizontal axis. The top bearing surface of the pile bearing platform 322 can be angled to correspond to the angle of the piles 110 such that the top bearing surface is approximately horizontal or level when the pile bearing platform 322 is installed on a pile 110. While FIG. 3 shows the notched portion of the pile bearing platforms 322 as being open-faced, the notched portion can have a wall such that the internal volume is substantially enclosed. The pile bearing platforms 322 can each have one or more vertical support walls disposed within the internal volume and extending between the top and bottom surfaces.

The pile bearing platforms 322 can be configured to attach or connect to one or more attachment half-rings 324 such that the notch of each pile bearing platform 322 and the inner edge of each corresponding attachment half-ring 324 abuts the side of a corresponding pile 110. Each pile bearing platform 322 can be attached to a corresponding attachment half-ring 324 via any useful connection device or mechanism such as a bolt, a threaded rod, a screw, a fastener, or the like. Once the pile bearing platform 322 is connected to the corresponding attachment half-ring 324, the combination of the pile bearing platform 322 and the attachment half-ring 324 can be configured to apply compressive forces to the side surface of the respective pile 110 such that the combination of the pile bearing platform 322 and the attachment half-ring 324 is attached to the pile 110. Each pile bearing platform 322 can be configured to attach to multiple attachment half-rings 324, such as an upper attachment half-ring 324 and a lower attachment half-ring 324. One of the upper and lower attachment half-rings 324 can be configured to attach to one or more transverse struts 326 (e.g., two transverse struts 326). Each transverse strut 326 can extend between attachment half-rings 324 corresponding to adjacent pile bearing platforms 322, which can provide bracing that can help provide stability and support to the piles 110 and pile bearing platforms 322 and that can help prevent the pile bearing platforms 322 from shifting or rotating relative to one another or the piles 110.

The pile bearing platform system 220 can include one or more shear engagement rings 328. The shear engagement ring 328 can have two or more segments that can join together to form a ring. The shear engagement ring 328 can have two or more hinged segments that can rotate to open and close. The shear engagement ring 328 can be configured to close around a pile 110. One or more of the hinged segments of the shear engagement ring 328 can have a fixed pin 329 that projects radially inward toward the center of the ring. The fixed pin 329 in the shear engagement ring 328 can be configured to insert into a hole in the pile 110 such that the shear engagement ring 328 can provide a shear connection with the pile 110. The shear engagement ring 328 can be configured to attach to a pile 110 within and/or below the pile bearing platform 322 to support the pile bearing platform 322 (and objects or components ultimately installed on or on top of the pile bearing platforms) and prevent linear movement of the pile bearing platform 322 along the pile 110. For example, the pile bearing platform 322 can be configured to be installed above the shear engagement ring 328 such that a bottom portion of the pile bearing platform 322 can be positioned on top of the shear engagement ring 328. As another example, the pile bearing platform 322 can include a slot or receiving portion that is configured to receive a portion of the shear engagement ring 328 such that the shear engagement ring can support the pile bearing platform 322. The shear engagement ring 328 can include one or more apertures or through-holes configured to align with one or more apertures or through-holes that extend through a portion of the pile bearing platform 322. The through-holes of the shear engagement ring 328 and the pile bearing platform can be configured to receive a bolt, pin, or other connector, which can prevent or restrict rotation of the pile bearing platform 322 relative the shear engagement ring 328 and/or the pile 110. The shear engagement ring 328 can be installed on a pile 110 using a through-bolt, pin, or similar mechanisms installed through apertures of the shear engagement ring 328 such that the shear engagement ring 328 is attached to the pile 110 via friction, compression forces, and/or other forces. Alternatively or in addition, the shear engagement ring can be attached to the pile via shear forces, as described above.

The bearing frame 240 can be configured to attach to the bearing platform system 220. For example, the bearing frame 240 can include multiple bearing beams (or girders) 442. As a more specific example, the bearing frame 240 can include a plurality (e.g., three) of bearing beams 442. One or more tabs 444 can be attached to a top surface or flange of a bearing beam 442. The tabs 444 can be a plate or a pair of plates separated by a space configured to receive the end of a brace member, as will be described more fully below. The tabs 444 can each include one or more apertures for receiving a securing member (such as a bolt, a pin, a screw, a fastener, or the like) and can attach to the end of a brace member by, for example, inserting a bolt through the aperture(s) of the tab 444 and through one or more corresponding apertures of the brace member and securing the securing member with a nut or the like.

Each bearing beam 442 can be positioned on top of pile bearing platforms 322 positioned on top of pile bearing platforms 322 and can extend between adjacent pile bearing platforms 322. As used herein, the term "on top" does not preclude the presence of one or more intermediary objects, such that a scenario in which a first object is located on top of a second object does not require the first object to directly abut the second object. An end of each bearing beam 442 can be attached to an end of an adjacent bearing beam 442 via a plate connection system. The plate connection system can include an acute bent plate 446 and an obtuse bent plate 448. That is, each end of a bearing beam 442 can directly bear on a respective pile bearing platform 322, such that each pile bearing platform 322 supports an end of two adjacent bearing beams 442. Alternatively or in addition, the bearing beam 442 can be configured to attach to the pile bearing platform 322 via an intermediate connection, such as a ball and socket connection (not shown). This may help facilitate construction of an approximately level bearing frame 240, as intermediate connections can provide some level of maneuverability between each end of each individual bearing beam 442 and the corresponding pile bearing platform 322. For example, a ball can be attached (e.g., welded, bolted) to the bottom of the bearing beam 442 and a corresponding socket can be attached (e.g., welded, bolted) to the top (e.g., top bearing surface) of the pile bearing platform 322, or vice versa. An intermediate connection between the pile bearing platform 322 and bearing beams 442 can help compensate for any variations in height or levelness between the multiple pile bearing platforms that could ultimately result in an uneven bearing frame 240.

Figure 4:
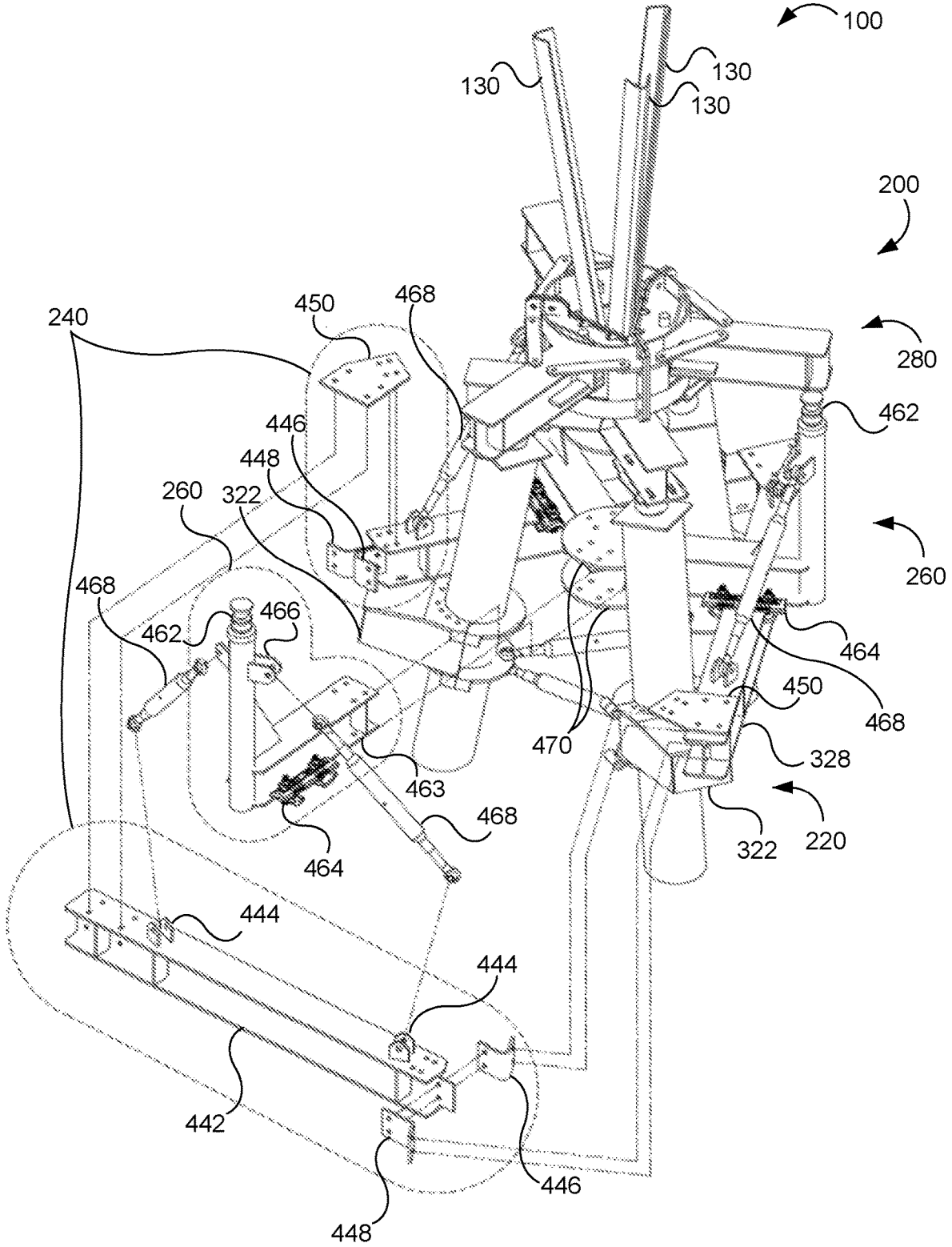
FIG. 4 illustrates a partially exploded perspective view of an example assembled temporary support structure with a portion of the jack assembly exploded for illustrative purposes, in accordance with the disclosed technology.

The adjacent ends of a pair of bearing beam 442 can be connected to one another by an acute bent plate 446 and an obtuse bent plate 448 of the bearing beam 442, which can create a skewed double bent plate shear connection. As shown in FIG. 4, an acute bent plate 446 and/or an obtuse bent plate 448 can be attached to the web (i.e., the vertical center plate) of a bearing beam 442 by aligning one or more apertures of the bent plates 446, 448 with one or more apertures of the web and attaching them together with securing members such as bolts, screws, fasteners, or the like. Additionally or alternatively, a pair of adjacent bearing beams 442 can be connected by one or more connection plates 450 positioned atop and/or below the bearing beams 442. The connection plate(s) 450 can be parallel to the top/and or bottom surface or flange of the bearing beams 442. The connection plates 450 can each have apertures that align with apertures of the top and/or bottom surface or flange of the bearing beams 442, and the connection plates and corresponding bearing beams 442 can be attached together with securing members such as bolts, screws, fasteners, and the like. Regardless of the type of connector, the bearing beams 442 can connect to each other to create a bearing frame 240 that can be in the shape of a triangle (or any other such shape that mirrors the number of sides of the flower pot 120 and/or the number of piles 110). Each of the bearing beams 442 can be placed across a corresponding pair of pile bearing platforms 322 such that each bearing beam 442 is approximately parallel to a face of the flower pot 120 of the transmission tower 100. Each bearing beam 442 can directly bear on the underlying pair of pile bearing platforms 322 or on an intermediate connection between the bearing beams 442 and the pile bearing platforms 322, as described above. When the temporary support structure 200 has been fully assembled, the bearing beams 442 can serve to accept and transfer loads from the flower pot adapter assembly 280 and lifting system 260 to the bearing platform 220.

The lifting system 260 can be positioned on the bearing frame 240. The lifting system 260 can include one or more lifting mechanisms, such as one or more jacks 462. The jack 462 can be or include one or more of a screw jack, mechanical jack, hydraulic jack, hydraulic ram, or any other device configured to raise and lower an object. The jacks 462 can be positioned such that the jacks 462 can extend upwardly from the top of the bearing frame 240, such that the jacks 462 can ultimately lift the flower pot 120 off of the tripod 102. The lifting system 260 can include a jack 462 for each bearing beam 442 of the bearing frame 240, and each jack 462 can be positioned on the corresponding bearing beam 442 (e.g., near the middle of the corresponding bearing beam 442). Each jack 462 can be attached (e.g., via a corresponding jack beam 463) to the top flange of the corresponding bearing beam 442 via a beam clamping system 464. The beam clamping system 464 can be a girder clamp system or any useful clamp or connection system such as a Type FC Flush Clamp as manufactured by Lindapter International™. The beam clamping system 464 can be welded, bolted, or otherwise attached to or near the lowermost edge of the jack 462, and the beam clamping system 464 can be configured to releasably clamp to the top flange of the bearing beam 442. One or more tabs 466 can be attached to the jack 462 (e.g., near the top of the jack 462). The tabs 466 can be the same or similar to the tabs 444 of the bearing beams 442. Alternatively, the tabs 466 can be different from the tabs 444 of the bearing beams.

The ends of a brace member, such as oblique struts 468, can attach the jacks 462 to the corresponding bearing beams 442. For example, each oblique strut 468 can be attached to corresponding tabs 466 of a respective jack 462 and corresponding tabs 444 of a respective bearing beam 442. The oblique struts 468 can each be secured by a bolt, pin, or other securing mechanism. For example, the bolt can extend through the tab 444, 466. Once attached to via the bolt, the oblique strut 468 can be free to rotate about the bolt (that is extending through the tab 444, 466) as a hinge or pinned connection, such that the opposing end of the oblique strut 468 can be raised or lowered to different heights of differing jacks 462 or to accommodate jacks 462 positioned in slightly different placement locations relative the corresponding bearing beams 442, as non-limiting examples. The opposite end of the oblique strut 468 can be attached to the available tab 466 of the jack 462 or tab 444 of the bearing beam 442, as the case may be. Each jack 462 can be attached to the corresponding bearing beam 442 via multiple oblique struts 468, such as by two oblique struts 468 as depicted in FIG. 4. The oblique struts 468 can help brace and provide lateral stability to the jacks 462 and prevent the jacks 462 from shifting or rotating relative to one another or the corresponding bearing beams 442.

The jack 462 can have a jack beam portion 463 that can extend radially inward from the corresponding bearing beam 442 to a central area (e.g., below the flower pot 120). The jack beam portion 463 can be an I-beam or W-beam and/or can have a web, a top plate or flange, and a bottom plate or flange. The jack beam portion 463 can be positioned below the extending portion of the jack 462. The end of the jack beam portions 463 for each of the jacks 462 can attach to one or more center connection plates 470 (e.g., an upper center connection plate and a lower center connection plate). The center connection plate(s) 470 can have apertures that can align with apertures in the top plate or flange and/or bottom plate or flange of the jack beam portions 463, and the center connection plate(s) 470 can attach to the top and/or bottom plate(s) or flange(s) via any useful connection device or mechanism such as a bolt, pin, screw, fastener, or the like. The center connection plate(s) 470 can help provide stability and prevent outward rolling or other rotation or shifting of jacks 462.

If the jack 462 is a screw jack, for example, the jack 462 can include a screw and cap assembly attached to the jack beam portion 463. The screw and cap assembly can include a rod having a threaded screw portion (e.g., an Acme threaded screw) on one end and a ball bearing swivel cap on the other end. The screw and cap assembly can be premanufactured. The threaded screw portion can be configured to be rotatably received by a threaded shoulder nut (e.g., an Acme threaded shoulder nut) of the receiver tube of jack beam portion 463. Once fully assembled, the swivel cap can be positioned on top of a bearing beam 442 such that that load of the tower 100 can be transferred through a plurality of jacks 462 and into a corresponding plurality of bearing beams 442. The height of a flower pot adapter beam 590 can be raised by rotating the screw and cap assembly. Thus, once the flower pot adapter assembly 280 is installed and in connection to the flower pot 120, the height of the transmission tower 100 can be raised or lowered in accordance with the raising and lowering of the plurality of jacks 462. In this way, the temporary support structure 200 can be configured to raise the tower 100 to provide room to remove the damaged or degraded tripod 102 and lower the tower 100 onto a newly installed tripod 102 following such installation.

Figure 5:
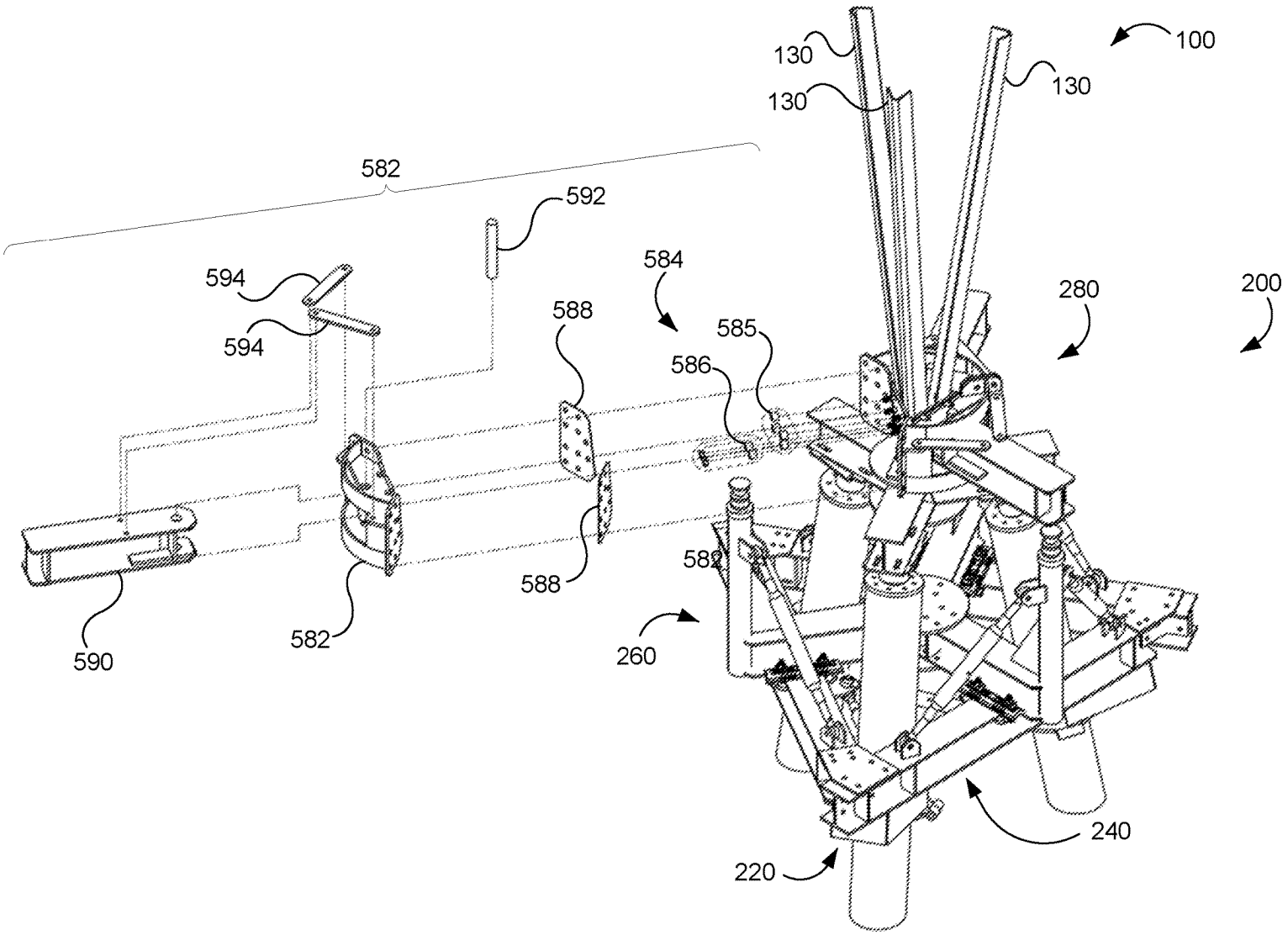
FIG. 5 illustrates a partially exploded perspective view of an example assembled temporary support structure with a portion of the flower pot adapter assembly exploded for illustrative purposes, in accordance with the disclosed technology.

FIG. 5 shows an example flower pot adapter assembly 280 that is partially exploded for illustrative purposes and partially assembled around a flower pot 120 of a transmission tower 100. The flower pot adapter assembly 280 can include a plurality of flower pot adapters 582 that are each configured to securely attach to an outer face of the flower pot 120. The flower pot adapters 582 can provide a direct connection of the flower pot adapter assembly 280 to the transmission tower 100. A flower pot adapter 582 can engage temporary flower pot adapter bearing sleeves with fasteners 584 to the face of the flower pot 120. The temporary flower pot adapter bearing sleeves with fasteners 584 can temporarily replace existing flower pot 120 fasteners and provide a bearing connection with a flower pot adapter 582. For example, existing nuts and bolts of the flower pot 120 can be removed and replaced with threaded sleeves 585, studs, and nuts, threaded sleeves 585 and bolts, or unthreaded sleeves 586, bolts, and nuts, depending on their location. For example, space constraints may not allow a technician to insert a wrench head or socket inside of the flower pot 120 onto the upper bolts and/or nuts, whereas threaded sleeves installed on the exterior of the upper bolts and studs can be tightened independently without having to turn the upper bolt heads and/or nuts on the interior of the flower pot 120.

As shown in FIG. 5, the flower pot adapters 582 can include flower pot adapter bolt flanges and shims 588 to provide connections between adjacent flower pot adapters 582 around the flower pot 120. Shims 588 can be used between the flanges to provide adjustment of the engagement relative to the faces of the flower pot 120. Each flower pot adapter 582 can be connected to a flower pot adapter beam 590 such as by a flower pot adapter pin 592, which can be an alloy steel pin. A flower pot adapter pin 592 can be inserted into transverse through-holes at both ends of the flower pot adapter beam 590 to provide retention of the flower pot adapter beam 590 within the flower pot adapter 582. The flower pot adapter beam 590 can be engaged directly by a jack 462 and can provide a load path to the flower pot adapter 582. The flower pot adapter beam 590 can have a bottom surface configured to come into contact with a portion of the jack 462 as the jack extends upwardly away from the bearing frame 240.

Reinforced flanges at the connections to flower pot adapter pin 592 can provide increased bearing strength. The reinforced flanges can be integrated into the flower pot adapter beam 590 itself. Bolt holes in the top flange of the flower pot adapter beam 590 can be used to restrain the flower pot adapter beam 590 and connect flower pot adapter beam braces 594, which can prevent pivoting of the flower pot adapter beam 590 relative the flower pot adapter 582. The flower pot adapters 582 can be attached to all sides of the flower pot 120 prior to the attachment of the flower pot adapter beams 590.

Figure 6:
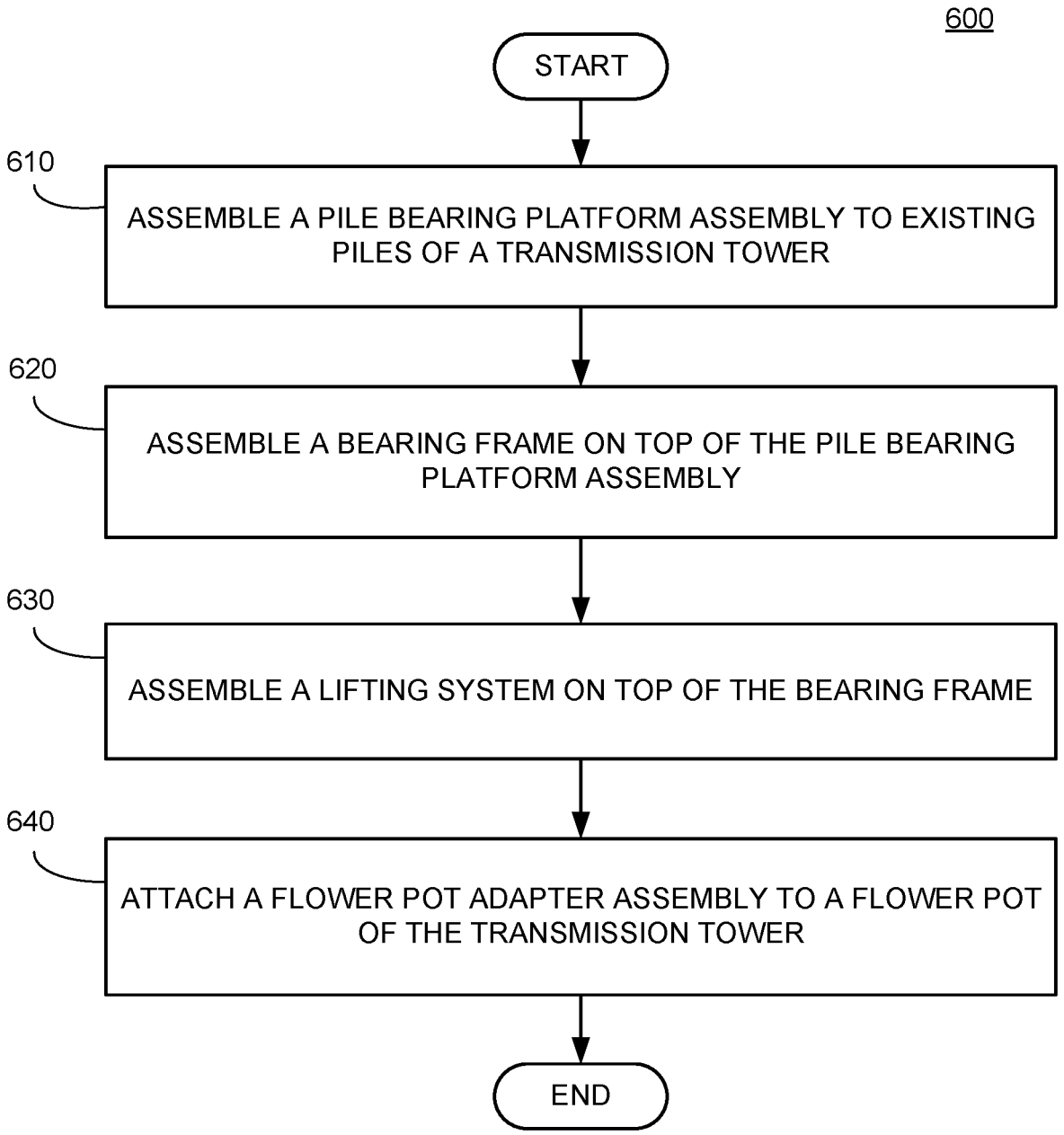
FIG. 6 illustrates a flow diagram of an example method for assembling a temporary support structure, in accordance with the disclosed technology.

FIG. 6 is a flow diagram of an example method 600 for assembling a temporary support system. The method can include assembling 610 a pile bearing platform assembly (e.g., pile bearing platform assembly 220), which can include pile bearing platforms (e.g., pile bearing platforms 322) and one or more attachment apparatuses, around a base of a transmission tower 100. Attaching the pile bearing platforms to piles of the base of the transmission tower can be performed in accordance with any of the techniques or methodologies described herein. For example, attaching the pile bearing platforms can include attaching a first pile bearing platform to a first pile of the plurality of piles, attaching a second pile bearing platform to a second pile of the plurality of piles, and attaching a third pile bearing platform to a third pile of the plurality of platforms Each pile bearing platform can be connected to either adjacent pile bearing platform via a transverse strut such that a transverse strut extends between and connects each pair of neighboring or adjacent pile bearing platforms.

The method 600 can include assembling 620 a bearing frame (e.g., bearing frame 240) on top of the bearing platform system such that the bearing platform system supports the bearing frame. As used herein, the term "on top" does not preclude the presence of one or more intermediary objects, such that a scenario in which a first object is located on top of a second object does not require the first object to directly abut the second object. The bearing frame can include at least a plurality of bearing beams (e.g., bearing beams 442) that can be assembled together to form a bearing frame such as described above. For example, these support beams can be attached to one another via one or more bent plates (e.g., acute bent plate 446, obtuse bent plate 448) and/or one or more connection plates (e.g., connection plate 450) such as described above.

The method 600 can include assembling 630 a lifting system (e.g., lifting system 260) on top of the bearing frame. Assembling the lifting system can include positioning one or more height-adjustable jacks (e.g., jack 462) on the bearing frame. For example, a jack can be placed on each bearing beam. Each jack can be attached to the corresponding bearing beam via one or more beam clamping or connection systems (e.g., beam clamping system 464) and/or one or more oblique struts (e.g., oblique strut 468) such as described above. Each jack can include a jack beam (e.g., jack beam 463) that can be attached to the remaining jack beams via one or more center connection plates (e.g., center connection plate 470), such as described above.

The method 600 can include attaching a flower pot adapter assembly (e.g., flower pot adapter assembly 280) to the flower pot of the transmission tower. The flower pot can be positioned above the tripod of the transmission tower and can be configured to hold one of more legs of the tower (e.g., chordal members at the bottom of the latticed mast of the tower); as a more specific example, legs of the tower (e.g., chordal members at the bottom of the latticed mast) can be received by a receiving member or other component of the flower pot that is designed to securely receive and restrain the legs. In response to the installation of the flower pot adapter assembly 280 in connection with the flower pot and above the lifting system, the load of the transmission tower can be transferred from the flower pot to the flower pot adapter assembly (e.g., flower pot adapter assembly 280), from the flower pot adapter assembly to the lifting system (e.g., lifting system 260), from the lifting system to the bearing frame (e.g., bearing frame 240), from the bearing from to the bearing platform system (e.g., bearing platform system 220), and from the bearing platform system to the piles of the base of the tower. In other words, when installed (i.e., when attached to the flower pot and the piles), the temporary support system 200 can create a load path from the flower pot of the transmission tower to the piles of the transmission tower, thereby bypassing the existing tripod and enabling the transmission tower to be raised and lowered to replace the tripod and/or other damaged or degraded portions of the tower foundation.

It should be understood that the method 600 can include attaching one or more portions of the flower pot adapter assembly to the flower pot at any point during performance of the method 600 such as before assembling the pile bearing platform assembly and/or after assembling the lifting system. Attaching the flower pot adapter assembly to the flower pot of the transmission tower can include attaching a plurality of flower pot adapters (e.g., flower pot adapters 582) to external surfaces of the flower pot such that the flower pot is substantially surrounded by the plurality of flower pot adapters. Following the attachment of the plurality of flower pot adapters to the flower pot, each of the jacks can be raised to engage and lift a respective flower pot adapter (e.g., via a respective flower pot adapter beam 590).

The method 600 can further include removing the tripod and installing a new tripod. For example, removing the tripod can include unbolting the tripod from any existing installed brackets (e.g., brackets 114) attached to existing pile adapters (e.g., pile adaptors 112). Removing the existing tripod can include cutting and/or unbolting the existing tripod, the existing brackets, the existing pile adapters, and/or piles. Installing a new tripod can include installing a new pile adapter to each pile, installing a new pile bracket on each new pile adapter (e.g., via mating the two pieces together), attaching tripod beams of the new tripod 102 to the new pile brackets (e.g., via securing members through aligned apertures of a pile bracket 114 and bottom flange or plate 108 of a tripod beam 103), attaching a flower pot socket to a top surface of the new tripod, and lowering, by manipulation of the height-adjustable threaded screw of each of the jacks, the flower pot into the flower pot socket. Following installation of the new tripod, the temporary support structure can be deconstructed, such as by performing some or all of the method 600 in reverse.

It will be understood that the various steps of any of the methods described herein are illustrative only, and that steps can be removed, other steps can be used, or the order of steps can be modified.

Certain examples of the disclosed technology are described above with reference to flow diagrams of systems and methods according to example embodiments of the disclosed technology. It will be understood that some blocks of the flow diagrams may not necessarily need to be performed in the order presented, or may not necessarily need to be performed at all, in accordance with the disclosed technology.

While certain examples of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and can include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A temporary support structure comprising:

a bearing platform system comprising a plurality of pile bearing platforms, each pile bearing platform configured to attach to a respective pile of a plurality of piles of a base of a transmission tower;

a bearing frame configured to be installed on top of and supported by the bearing platform system, the bearing frame comprising a plurality of bearing beams;

a lifting system configured to be installed on top of and supported by the bearing frame; and a flower pot adapter assembly configured to attach to a portion of the transmission tower, the flower pot adapter assembly having a bottom surface configured to contact at least a portion of the lifting system to transfer a load of the transmission tower to the plurality of piles via the temporary support structure.

2. The temporary support structure of claim 1, wherein the lifting system is configured to remove the load of the transmission tower off of a tripod installed beneath a guyed latticed mast of the transmission tower.

3. The temporary support structure of claim 1, wherein each of the pile bearing platforms is configured to connect to an attachment half-ring to create compression forces on a side surface of the respective pile.

4. The temporary support structure of claim 1 further comprising one or more transverse struts, configured to attach to a pair of adjacent pile bearing platforms of the plurality of pile bearing platforms.

5. The temporary support structure of claim 1, wherein each pile bearing platform has a flat top surface, the plurality of pile bearing platforms being configured to attach to the plurality of piles such that that the flat top surfaces are approximately level with one another when the plurality of pile bearing platforms is installed.

6. The temporary support structure of claim 1, wherein each bearing beam of the plurality of bearing beams has a first end configured to be positioned on top of a first pile bearing platform of the plurality of pile bearing platforms and a second end configured to be positioned on top of a second pile bearing platform of the plurality of pile bearing platforms.

7. The temporary support structure of claim 1, wherein the lifting system comprise a plurality of height-adjustable jacks, each jack being configured to be positioned on top of a respective bearing beam.

8. The temporary support structure of claim 7, wherein at least one of the plurality of height-adjustable jacks is a screw jack.

9. The temporary support structure of claim 7, wherein at least one of the plurality of height-adjustable jacks is a hydraulic jack or a hydraulic ram.

10. The temporary support structure of claim 7, wherein each jack is configured to attach to the respective bearing beam via at least one of a beam clamping system and an oblique strut.

11. The temporary support structure of claim 7, wherein the flower pot adapter assembly comprises a plurality of flower pot adapters, each flower pot adapter comprising a flower pot adapter beam configured to interface with a portion of a respective jack.

12. The temporary support structure of claim 1, wherein the flower pot adapter assembly comprises a plurality of flower pot adapters, each flower pot adapter being configured to removably attach to an outer surface of a flower pot of the transmission tower that receives a guyed lattice mast of the transmission tower.

13. A method for removing a load of a transmission tower from a tripod of the transmission tower to enable replacement of the tripod, the method comprising:

attaching a pile bearing platform assembly to existing piles of a base of the transmission tower;

assembling a bearing frame on top of the pile bearing platform assembly such that the pile bearing platform assembly supports the bearing frame, the bearing frame comprising a plurality of bearing beams;

assembling a lifting system on top of the bearing frame; and attaching a flower pot adapter assembly to a flower pot of the transmission tower, the flower pot being positioned above the tripod and being configured to hold a guyed latticed mast of the transmission tower, wherein the load of the transmission tower is transferred from the flower pot to the flower pot adapter assembly, from the flower pot adapter assembly to the lifting system, from the lifting system to the bearing frame, from the bearing frame to the pile bearing platform assembly, and from the pile bearing platform assembly to the existing piles.

14. The method of claim 13 further comprising:

removing the tripod; and installing a new tripod.

15. The method of claim 13, wherein attaching the pile bearing platform assembly to the existing piles comprises:

connecting a shear engagement ring to each existing pile;

positioning a pile bearing platform on top of each shear engagement ring; and connecting an attachment half-ring to each pile bearing platform.

16. The method of claim 13, wherein assembling the bearing frame on top of the pile bearing platform assembly comprises:

for each pair of adjacent pile bearing platforms of a plurality of pile bearing platforms, placing a respective bearing beam of the plurality bearing beams on top of the pair of adjacent pile bearing platforms such that the plurality of bearing beams forms a substantially enclosed shape around the transmission tower; and securing an end of each bearing beam of the plurality of bearing beams to each of the respective pair of adjacent piles.

17. The method of claim 16, wherein assembling the bearing frame on top of the pile bearing platform assembly further comprises:

for each pair of adjacent bearing beams of the plurality of bearing beams, attaching a transverse strut to the respective pair of adjacent pile bearing platforms.

18. The method of claim 13, wherein assembling the lifting system on top of the bearing frame comprises:

positioning a plurality of screw jacks on top of the plurality of bearing beams such that a height-adjustable threaded screw of each of a plurality of screw jacks is positioned above an upper surface of a respective bearing beam of the plurality of bearing beams.

19. The method of claim 13, wherein attaching the flower pot adapter assembly to the flower pot of the transmission tower comprises:

attaching each of a plurality of flower pot adapters to a respective external surface of the flower pot such that the flower pot is substantially surrounded by the plurality of flower pot adapters; and attaching each of a plurality of flower pot adapter beams to a respective flower pot adapter.

20. The method of claim 19 further comprising:

causing a portion of the lifting system to move vertically upward such that at least some of the portion of the lifting system pushes upwardly against the plurality of flower pot adapter beams.

* * * * *